US008833010B1

(12) United States Patent
Schlabach

(10) Patent No.: US 8,833,010 B1
(45) Date of Patent: Sep. 16, 2014

(54) SKYLIGHT ASSEMBLY

(71) Applicant: Kenneth L Schlabach, Campbell Hill, IL (US)

(72) Inventor: Kenneth L Schlabach, Campbell Hill, IL (US)

( * ) Notice: Subject to any disclaimer, the term of this patent is extended or adjusted under 35 U.S.C. 154(b) by 0 days.

(21) Appl. No.: 14/209,170

(22) Filed: Mar. 13, 2014

Related U.S. Application Data

(60) Provisional application No. 61/782,414, filed on Mar. 14, 2013.

(51) Int. Cl.

| | |
|---|---|
| ***E04D 13/03*** | (2006.01) |
| ***E04D 1/36*** | (2006.01) |
| ***E06B 7/14*** | (2006.01) |
| *E04D 13/04* | (2006.01) |

(52) U.S. Cl.
CPC ..... *E04D 13/03* (2013.01); *E04D 13/0315* (2013.01); *E06B 7/14* (2013.01); *E04D 13/0305* (2013.01); *E04D 2013/049* (2013.01)
USPC ..... 52/200

(58) Field of Classification Search
CPC ..... E04D 3/03; E04D 3/0305; E04D 3/0315; E04D 3/0445; E04D 2013/149
USPC ..... 52/200
See application file for complete search history.

(56) References Cited

U.S. PATENT DOCUMENTS

| | | | | | |
|---|---|---|---|---|---|
| 3,461,625 | A | * | 8/1969 | Sandow | 52/58 |
| 4,073,097 | A | * | 2/1978 | Jentoft et al. | 52/22 |
| 4,388,784 | A | * | 6/1983 | Jentoft et al. | 52/200 |
| 4,409,767 | A | * | 10/1983 | Jentoft et al. | 52/200 |
| 4,439,962 | A | * | 4/1984 | Jentoft et al. | 52/200 |
| 4,449,340 | A | * | 5/1984 | Jentoft et al. | 52/200 |
| 4,455,799 | A | * | 6/1984 | Jentoft et al. | 52/200 |
| 4,473,979 | A | * | 10/1984 | Bruhm | 52/200 |
| 4,527,368 | A | * | 7/1985 | Jentoft | 52/200 |
| 4,589,238 | A | * | 5/1986 | Sampson et al. | 52/200 |
| 4,702,049 | A | * | 10/1987 | Sampson et al. | 52/200 |
| RE32,539 | E | * | 11/1987 | Jentoft et al. | 52/200 |
| 4,703,592 | A | * | 11/1987 | Sampson et al. | 52/20 |
| 4,788,804 | A | * | 12/1988 | Haas | 52/200 |
| 4,862,657 | A | * | 9/1989 | Jentoft et al. | 52/200 |
| 4,928,445 | A | * | 5/1990 | Sampson et al. | 52/72 |
| 4,987,705 | A | * | 1/1991 | Sampson et al. | 52/72 |
| 5,044,133 | A | * | 9/1991 | Sampson et al. | 52/72 |
| 5,046,292 | A | * | 9/1991 | Sampson et al. | 52/200 |
| 5,092,089 | A | * | 3/1992 | Kessler | 52/200 |
| 5,216,855 | A | * | 6/1993 | Richter et al. | 52/200 |
| 5,544,455 | A | * | 8/1996 | DeBlock | 52/200 |
| 5,553,425 | A | * | 9/1996 | Sampson et al. | 52/58 |
| 6,263,623 | B1 | * | 7/2001 | Weiss et al. | 52/200 |
| 7,631,464 | B2 | * | 12/2009 | Valentz et al. | 52/200 |
| 7,937,900 | B1 | * | 5/2011 | Gaffney et al. | 52/200 |
| 8,225,560 | B2 | * | 7/2012 | Valentz et al. | 52/200 |
| 8,291,674 | B2 | * | 10/2012 | Valentz et al. | 52/742.1 |
| 8,393,120 | B2 | * | 3/2013 | Valentz et al. | 52/200 |

* cited by examiner

*Primary Examiner* — Robert Canfield
(74) *Attorney, Agent, or Firm* — Wendy Thai

(57) ABSTRACT

The invention provides an improved skylight assembly having a condensate management mechanism effective to minimize condensation-related damage to adjacent structures and provide an anchor for a snap-fit extension frame that can support an optional glazing layer.

20 Claims, 13 Drawing Sheets

SKYLIGHT ASSEMBLY

CROSS-REFERENCE TO RELATED APPLICATIONS

This application claims priority to U.S. provisional application Ser. No. 61/782,414, filed Mar. 14, 2013, which is incorporated herein by reference in its entirety.

BACKGROUND

Artificial lighting is one of the largest sources of energy consumption in schools as well as in commercial and industrial settings. Skylights offer an effective way to reduce energy costs by enabling the use natural sunlight as a source of illumination—it presents an energy-efficient way to improve lighting, appearance and ambience, as well as comfort and productivity in homes, schools, commercial settings and the work place. Thus, a well designed and constructed skylight system provides many benefits including free and abundant illumination, warmth, ventilation, the associated health benefits from regular exposure to sunlight, improved ambience and comfort of the illuminated space, and increased aesthetic appeal and home value.

SUMMARY OF THE INVENTION

The invention provides a skylight assembly with a molded frame incorporating a condensation management mechanism that can also serves as anchor for an optional frame extension allowing the user to increase insulation power of the assembly as desired. The skylight assembly of the invention includes an outer glazing and an inner condensation trough operably secured together by a molded frame. The condensation trough of the invention has a dual function: it is effective for holding condensate as needed and can serve as an anchor member for a snap-fit extension frame used to support an additional glazing.

In one aspect, the invention provides a skylight assembly that includes an outer glazing for the transmission of light, an inner condensation trough for receiving interior condensate and a molded frame encasing a portion of the outer glazing and inner condensation trough. The outer glazing and inner condensation trough each includes a peripheral flange that is substantially or partially encased by the molded frame, and the molded frame includes an outer flange that contacts the outer glazing to form a leak tight joint.

In some embodiments, the skylight assembly also has a second glazing positioned between the outer glazing and the condensation trough, the second glazing including a peripheral flange substantially encased by the molded frame between the peripheral flange of the outer glazing and the peripheral flange of the condensation trough.

In some embodiments, the outer glazing includes a raised step section adjoining the peripheral flange, the raised step section adjoining and encircling a central dome.

In some embodiments, the edge of the raised portion of the step section is flushed with the exterior surface of the outer flange of the molded frame, and the raised portion of the step section forms a gentle upward slope rising from the edge of the outer flange of the molded frame to the adjoining central dome.

In some embodiments, the skylight assembly also has a second glazing positioned between the outer glazing and the condensation trough, the second glazing having a peripheral flange adjoining a central dome, the central dome having a curvature substantially similar to that of the outer glazing.

In some embodiments, the skylight assembly includes caulk or tape seal between the peripheral flanges of the outer and second glazing.

In some embodiments, the condensation trough includes a β-shape peripheral flange, and the exterior surface of one arm of the β-shape flange is flush with the underside of the molded frame. In some embodiments, the peripheral flange of the condensation trough includes a groove effective to receive caulk or tape seal for attaching the peripheral flange of the condensation trough to the second glazing.

In some embodiments, the condensation trough includes a reservoir section that extends along the edges of the skylight to receive condensate from the interior of the skylight. In some embodiments, the reservoir section of the condensation trough aligns with the slope of the outer glazing thereby enabling two or more skylight assemblies to be stacked one on the other. In some embodiments, the reservoir section of the condensation trough includes a horizontal base adjoining a diagonal corner segment, which, in turn adjoins a vertical wall segment, and the horizontal base, diagonal corner segment and vertical wall segment form a structure that aligns with the slope of the outer glazing thereby enabling two or more skylight assemblies to be stacked one on the other. In some embodiments, the condensation trough further includes an underside groove for securely engaging a snap-in extension frame for supporting an additional glazing.

In some embodiments, the skylight assembly includes an additional glazing held in place by a snap-in extension frame secured to the condensation trough. In some embodiments, the additional glazing includes a substantially flat panel or a dome.

In some embodiments, the molded frame of the skylight assembly includes an inner flange embedded between the outer peripheral flange and the second peripheral flange. In some embodiments, the molded frame further includes an inner flange embedded in the β-shaped flange of the condensation trough. In some embodiments, the molded frame further includes two inner flanges, one embedded between the outer peripheral flange and the second peripheral flange, and a second embedded in the β-shape flange of the condensation trough. In some embodiments, the molded frame further includes a roof curb collar section that surrounds the upper portion of the roof curb on which the skylight assembly is securely mounted. In some embodiments, the molded frame further includes a gasket section effective to form a leak tight seal between the molded frame and the top edge of a roof curb when the skylight assembly is securely mounted on the roof curb. In some embodiments, the condensation trough is integrally molded with the frame.

In another aspect, the invention provides a condensation trough for receiving condensate that includes a reservoir section for receiving skylight condensate integrally molded with a rear flange for securing the reservoir section to the frame of a skylight. In some embodiments, the reservoir section includes a form that aligns with the curvature of the glazing with which it is assembled. In some embodiments, the rear flange is a β-shape flange. In some embodiments, the rear flange of the condensation trough includes an underside groove for securely engaging a snap-fit extension frame for supporting an additional glazing. In some embodiments, the snap-fit extension frame includes a cantilever having a hooked, studded or beaded end. In some embodiments, the condensation trough further includes stiffening ribs.

In another aspect, the invention provides a snap-in extension frame effective to mate with a condensation trough, the snap-in extension frame including a glazing support means effective to support a glazing. In some embodiments, the snap-in extension frame includes a cantilever having a hooked, studded or beaded end for mating with the condensation tray.

In another aspect, the invention provides a skylight assembly that includes: (a) an outer glazing secured in stacked configuration to an inner glazing, the glazings comprising peripheral flange sections and central body sections having substantially similar curvatures; (b) a first sealer means disposed between the flanges of the outer and inner glazings to form leak tight joints; (c) a condensation trough secured beneath an edge of the inner glazing comprising a reservoir section situated beneath an effective edge of the inner glazing to receive condensate from the interior surface of the inner glazing, the reservoir section adjoining a mounting flange section comprising two substantially parallel flanges in stacked alignment beneath the flange of the inner glazing; (d) a second sealer means disposed between the flange of the inner glazing and a flange of the condensation trough to form a leak-tight joint; (e) a molded frame comprising an upper portion and a wider lower portion, wherein the upper portion comprises an outer flange one end portion of which is contiguous with a body section, the outer flange and body section encasing the peripheral flanges of the glazings and mounting flange section of the condensation trough, the outer flange forming a leak-tight joint with the top surface of the peripheral flange of the outer glazing, the outer flange and body section comprising interior surfaces that contact encased portions of the glazings, sealer means and condensation trough to form leak-tight joints therewith, the body section comprising an underside flushed with the lower edge of the mounting flange section, and wherein the wider lower portion of the frame comprises the lower portion of the body section and a downwardly elongated roof curb collar, the upper portion of which is contiguous with the lower portion of the body section, the collar forming an opening below the concentration trough effective to accommodate the upper portion of the molded frame for stacking two or more skylight assemblies one partially within the other; and (f) a gasket secured to the underside of the center body section of the frame and a portion of the lower edge of the mounting flange section.

In some embodiments of a skylight assembly of the invention, the center bodies of the outer and inner glazings are dome-shaped. In some embodiments of a skylight assembly of the invention, the outer glazing further includes a raised step section adjoining the peripheral flange, the raised step section adjoining and encircling a central dome. In some embodiments of a skylight assembly of the invention, the edge of the raised portion of the step section is flushed with the exterior surface of the outer flange of the molded frame, and the raised portion of the step section forms a gentle upward slope rising from the edge of the outer flange of the molded frame to the adjoining central dome. In some embodiments of a skylight assembly of the invention, the first sealer means includes caulk or glazing tape.

In some embodiments of a skylight assembly of the invention, the flange of the condensation trough that is secured to the flange of the inner glazing includes a groove within which the second sealer means is disposed. In some embodiments of a skylight assembly of the invention, the second sealer means includes a glazing compound.

In some embodiments of a skylight assembly of the invention, the condensation trough includes a closed loop structure that extends beneath the entire edge of the inner glazing. In some embodiments of a skylight assembly of the invention, the reservoir section of the condensation trough substantially aligns with the slope of the outer glazing thereby enabling two or more skylight assemblies to be stacked one on the other. In some embodiments of a skylight assembly of the invention, the reservoir section of the condensation trough includes a substantially horizontal base adjoining a substantially diagonal corner segment, which, in turn adjoins a substantially vertical wall segment, and the horizontal base, diagonal corner segment and vertical wall segment form a structure that aligns with the slope of the outer glazing thereby enabling two or more skylight assemblies to be stacked one on the other. In some embodiments of a skylight assembly of the invention, the condensation trough further includes an underside groove for securely engaging a snap-fit extension frame. In some embodiments of a skylight assembly of the invention, the condensation trough includes a structural stiffener. In some embodiments of a skylight assembly of the invention, the structural stiffener is a stiffening rail lining the channel formed between the flanges of the condensation trough thereby strengthen the mounting flange section of the condensation trough.

In some embodiments of the invention, the skylight assembly includes an additional glazing supported by a snap-fit extension frame, the snap-fit extension frame having a cantilever structure secured to the condensation trough through an anchor arm with a hooked, studded or beaded end that engages with the underside groove of the condensation trough. In some embodiments of a skylight assembly of the invention, the additional glazing includes a substantially flat panel or a dome-shaped panel.

In some embodiments of the invention, the skylight assembly further includes a snap-fit extension frame secured to the condensation trough through a snap-fit mechanism, wherein the snap-fit extension frame comprises a double-cantilever structure, the extension frame being secured to the condensation trough through an anchor arm that includes a hooked, studded or beaded end. In some embodiments of the invention, the skylight assembly further includes an additional glazing supported by the snap-fit extension frame. In some embodiments, the additional glazing comprises a substantially flat panel or a dome-shaped panel.

In some embodiments of a skylight assembly of the invention, the frame and gasket are integrally molded.

In some embodiments of a skylight assembly of the invention, the condensation trough is integrally molded with the frame.

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

Other features and advantages of the invention will be apparent from the following detailed description and from the claims.

DETAILED DESCRIPTION OF THE INVENTION

The invention provides a skylight assembly with a molded frame incorporating a condensation management mechanism that also serves as anchor for an optional frame extension allowing the user to increase insulation power of the assembly as desired. The skylight assembly of the invention includes an outer glazing, optionally, one or more inner glazings, and an inner condensation trough held together by a molded frame. The condensation trough of the invention can be dual functioning by providing a surface area for receiving and/or evaporating condensate as needed and serving as anchor for a snap-fit extension frame that can be used to support an additional glazing.

To form a skylight assembly of the invention, an outer glazing, optionally, one or more glazings, and a condensation trough are assembled to form a subassembly. A sealer means, i.e., sealer, glazing compound or adhesive, including, without limitation, glue, caulk, glazing tape (e.g. double sided), foam seal, glue or a combination thereof can be incorporated between glazings or between glazing and condensation trough. The condensation trough can be attached beneath one or more glazings, positioned along the effective edge of the glazing and oriented so the reservoir section is effective to receive condensate from the interior side of the glazing, e.g., condensate that trickles along the interior side of the glazing towards its edge. As used herein, the term "effective edge," as used in reference to the glazing, refers to the visible or exposed sections of the glazing at the edge of the skylight opening, in contrast to the actual edge of the glazing, which is encased in the molded frame. The subassembly is then placed in the mold, and a frame integrally molded with an exterior flange, side collar and center body is formed around the subassembly. Incorporating the subassembly into the mold for the injection molding process produces a seemless skylight assembly with improved joints between the various components of the assembly and improved durability of the skylight.

Glazing

A skylight assembly of the invention includes an outer glazing, and optionally, one or more inner glazings. The glazing can be made of any substantially rigid, light-transmissive material known to those of skill in the art including glass or plastic such as clear or tinted glass, float glass, tempered glass, laminated glass, coated glass, impact glass, snowload glass, acrylic, polycarbonate or a combination thereof.

Figure 8A:
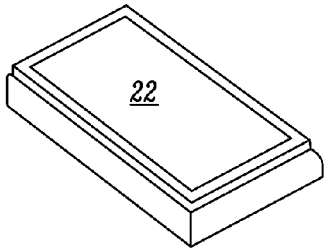
FIGS. 8A-8F are exterior perspective views of skylight assemblies having single unit and multi-unit glazing systems in which the frame, condensation trough and snap-fit extension frames of the invention can be utilized including assemblies that have: a single flat glazing system (8A); a single round dome system (8B); a single square dome system (8C); a single rectangular dome system (8D); a multiple, linearly arranged dome system (8E); and a multiple, clustered dome system (8F).
Figure 8B:
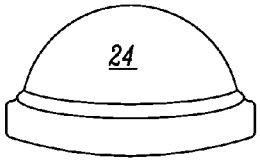
Figure 8C:
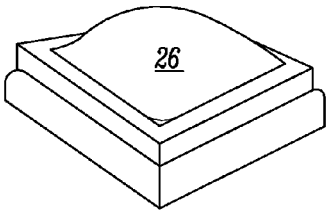
Figure 8D:
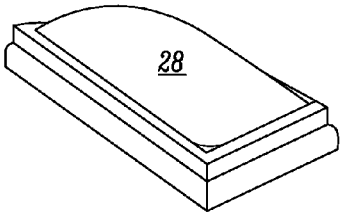
Figure 8F:
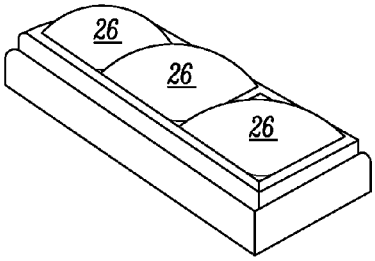
Figure 8E:
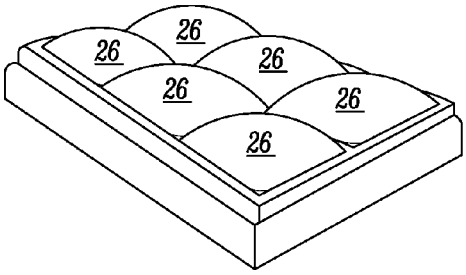

As used herein, the term "glazing" refers to one or more than one substantially rigid, light transmissive panels that come together to form barrier. The glazing in a skylight assembly of the invention can be any shape, for example, flat (FIG. 8A), convexly curved or dome-shaped (FIGS. 8B-8F). Where curved or dome-shaped, the glazing can have a circular, square, rectangular, or elliptical edge, i.e. a circular, square, rectangular or elliptical periphery or footprint, as shown in FIGS. 8A-8D. Glazings with rectangular peripheral edges or footprints are shown in FIGS. 8A and 8D. A glazing that has a square peripheral edge is shown in FIG. 8C, and a glazing that has a circular peripheral edge is shown in FIG. 8B.

Figure 10A:
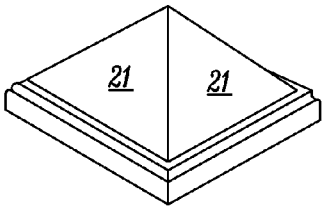
FIGS. 10A-10E exterior perspective views of various skylight assemblies having a variety of multi-panel glazing systems with which the frame, condensation trough and snap-fit extension frames of the invention can be utilized including assemblies that have: a pyramidal glazing system (10A); a trapezoidal glazing system (10B); a ridge-style glazing system (10C); a barrel-shaped glazing system with flat or rounded ends (10D & 10E, respectively).
Figure 10B:
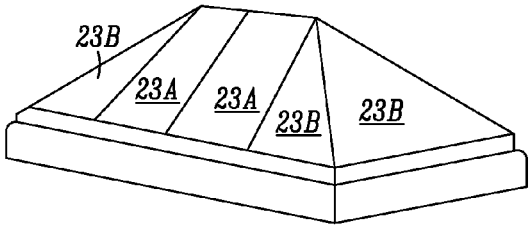
Figure 10C:
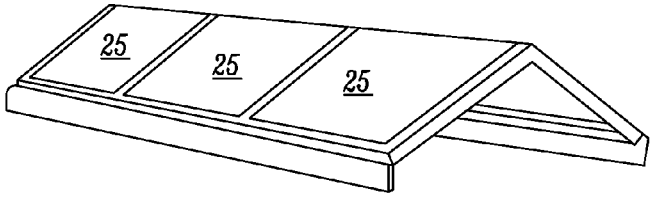
Figure 10D:
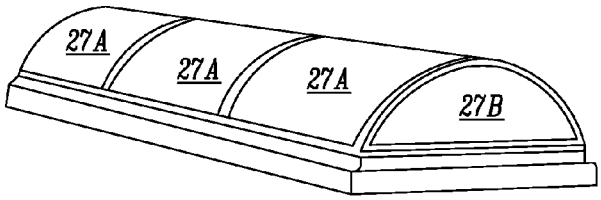
Figure 10E:
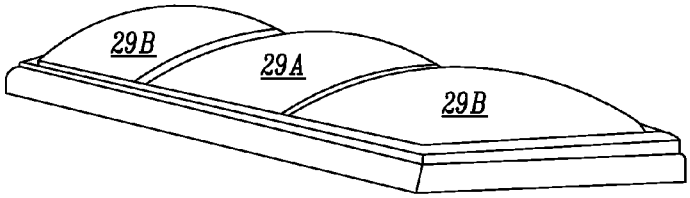

The glazing can also be a sub-assembly of two or more flat or curved panels. Examples of sub-assemblies of two or more flat panels include the four triangular panels that form a pyramidal structure as shown in FIG. 10A, or the combination of triangular, rectangular or trapezoidal panels that form a vaulted trapezoid as shown in FIG. 10B. An example of a sub-assembly of two or more curved panels are illustrated in FIGS. 10D and 10E. The glazing can also be a grouping of two or more flat panels having sides that meet to form a ridge as shown in FIG. 10C; or a linear grouping of two, three or more curved panels that come together to form a barrel vault as shown in FIGS. 10D & 10E.

The glazing in a skylight assembly of the invention is integrally formed with at least two sections: a center body section through which light can be transmitted and a peripheral flange section surrounding the center body for attaching to the molded frame. Where the glazing is flat (FIG. 8A), the peripheral flange section is the outer perimeter of the glazing. Where the glazing is convexly-curved or dome shape, e.g. round, square or rectangular domes (FIGS. 8B-8D), the glazing is integrally formed with a flat, peripheral flange section (not shown) to which the molded frame, sealer or other components can be attached, the peripheral flange section adjoining a curved center body section that forms the dome through which light is transmitted. Similarly, where the glazing is a sub-assembly of two or more panels as shown in FIGS. 10A-10E, the glazing also includes a flat peripheral flange section composed of the perimeter sections of the two or more panels (not shown) through which the panels can be attached to a frame or other components of the skylight assembly.

In some embodiments, the glazing can be integrally formed with a third, differently shaped section interposed between the peripheral flange and the center body. For example, the glazing can include a peripheral flange section that adjoins a raised step section that extends into a center dome section (see glazing 20 shown in FIGS. 1C, 3C and 4). The raised step section can include rounded or sharp edges. For example, step section 20B of glazing 20 illustrated in FIG. 1C can include a rounded or sharp edge where the substantially vertical portion of step 20B adjoins the substantially horizontal portion of step 20B, a rounded or shape edge where the peripheral flange (e.g. section 20A) adjoins the substantially vertical portion of step 20B, and a rounded or sharp edge where the substantially horizontal portion of step 20B adjoins the center body section (e.g. section 20C) of the glazing.

Condensation Trough, Gasketing & Snap-Fit Extension Frame

The skylight assembly of the invention includes a condensation trough that has a reservoir section, i.e., a surface effective to receive condensate or allow evaporation of condensate from the skylight and its vicinity. The reservoir section can have any open structure that is effective to receive, hold and allow evaporation of condensate. Thus, the reservoir section can be an upwardly curved flap or a rectangular trough with sharp, rounded or angular corners. In some embodiments, the reservoir section can be shaped to align with the exterior glazing so as to facilitate stacking of multiple skylight assembly units as shown in FIG. 3C. Thus, the reservoir section, if angular, can have a corner oriented at about 45° or any angle that aligns with the curvature of the outer glazing.

The condensation trough is integrally formed with a mounting flange behind the reservoir section for securing the condensation trough to the skylight assembly. In the skylight assembly, the condensation trough is mounted beneath one or more glazings to receive condensate that form on the interior side of the glazing. Thus, the condensation trough can be placed beneath the innermost glazing, between the outer glazing and an inner glazing, or between two inner glazings.

Figure 9:
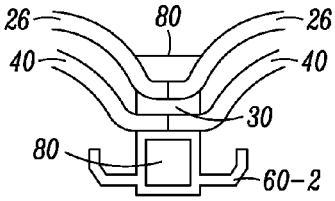
FIG. 9 is a cross-section of an assembly incorporating a condensation trough that can be inserted between domes in the multiple dome system of FIG. 8E or 8F.

The condensation trough can have a linear or closed loop structure. The condensation trough can have a linear structure configured to attach to one side of a skylight opening. For example, a linear condensation trough can be attached to the long side of the skylight of FIG. 10C. Alternatively, the condensation trough can have a closed structure, for example, it can be a square, rectangular, circular, or oval structure to fit a square, rectangular, circular or oval skylight opening. In this case, the condensation trough has generally the same shape as the skylight opening. For the skylight of FIGS. 8A, 8C, 8D, 10A, 10B, 10D and 10E, for example, the condensation trough can be a quadrilateral, e.g. a square (FIGS. 8C and 10A) or rectangular (FIGS. 8A, 8D, 10B, 10D and 10E) and can be placed beneath the glazing along all four sides. In the skylight of FIG. 8B, the condensation trough is circular and is attached beneath the glazing along the entire circumference of the skylight opening. The condensation trough can also have an irregular structure. In the linearly arranged or clustered skylight system of FIG. 8E or 8F, for example, the condensation trough can be placed beneath each glazing and along all four sides of each glazing to provide a channel beneath each glazing to receive and hold condensate. Condensation troughs inserted between adjacent panes can include two reservoir sections joined by a center flange (FIG. 9) such that the unit has internal symmetry. Thus, the condensation trough can have an elongated structure that can extend from corner to corner along one or more sides of the skylight assembly or all around the perimeter of the opening of the skylight.

Figure 4:
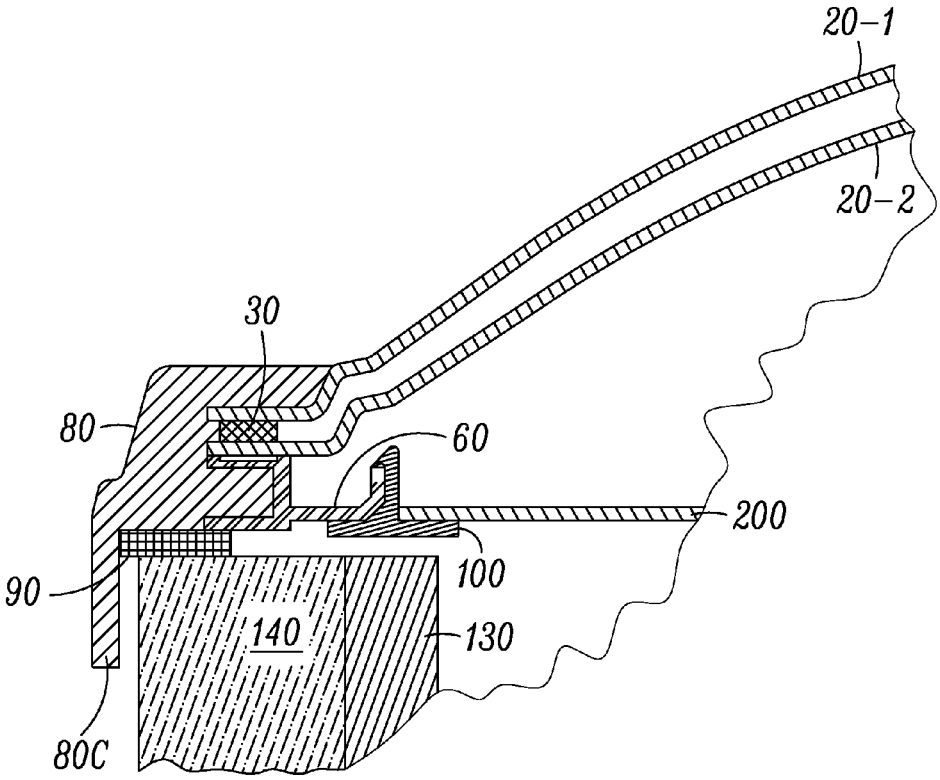
FIG. 4 is a sectional view of a skylight assembly of the invention that includes a snap-fit extension frame secured to the condensation trough and used to support a third glazing.

The condensation trough can include an undercut, depression, groove, notch, channel or opening along the underside exposed surface of the flange for mating with a protruding part such as a hook, stud or bead on a snap-fit extension frame for supporting an optional glazing. The snap-fit joint between the condensation trough and extension frame can be annular, cantilever, torsional, or β-shaped, as known to those of skill in the art. See for example, Handbook of Plastics Joining: A Practical Guide 121-133, Plastics Design Library 1997; G. Erhard, Design with Plastics 311-334, Carl Hanser Verlag, 2006; and Snap-Fit Joints for Plastics: A Design Guide, Bayer Material Sciences (available at http://fab.cba.mit.edu/classes/S62.12/people/vernelle.noel/Plastic_Snap_fit_design.pdf, last visited Mar. 10, 2013). In general, the snap-fit extension frame has a horizontal glazing support member and a protruding end for mating with the condensation trough. The extension frame can be mated to the reservoir section of the condensation trough as shown in FIG. 4, for example, or it can be anchored to an undercut in the flange section, an example of which is shown in FIGS. 5A-5D. The glazing can rest on the extension frame as shown in FIG. 4, or it can be inserted between the base of the condensation trough and the extension frame (FIGS. 5E and 5F). The snap-fit extension frame allows an additional glazing to be added to the skylight assembly during field installation of the skylight or as needed by the user, for example, to increase insulation power of the skylight. The extension frame can also have a channel for accommodating a sealer or adhesive such as glue, double sided glazing tape or a glazing compound between the optional glazing and the extension frame. See, for example, FIG. 5A, channel 675, and FIG. 6A, channel 6750.

The condensation trough, as well as the snap-fit extension frame can include a structural stiffener to reinforce the strength of selected sections as needed. The condensation trough, for example, can include stiffening ribs that extend partially or substantially the length of the condensation trough for increased strength. A stiffening rail can be added to the flange section as shown in FIG. 6C. In these embodiments, the flange can be shaped to accommodate or retain the stiffening rail as shown in FIG. 6C. In addition, one or more sections serving as an anchor point for the snap-fit extension frame such as sections 60D, 60A, 60C and 60B shown in FIG. 2C and FIG. 4 can include stiffening ribs or stiffening rails as needed. The stiffener can be made of any materials known to those of skill in the art including, for example, aluminum or steel.

The condensation trough and/or snap-fit extension frame can be made using any process and material known to those of skill in the art. The condensation trough and/or snap-fit extension frame can be injection molded as one piece or made from extruded polyvinyl chloride (PVC) or a similar material that is mitered and connected at the corners as appropriate. The condensation trough and/or snap-fit extension frame can be made of one or more synthetic or non-synthetic materials including, without limitation, metals, elastomers as well as thermoplastics or thermosetting polymers. Examples include, without limitation, thermoplastics such as polyester resin, acetal resin, nylon resin and other engineering-type thermoplastics such as acetals. Additional examples include: ultra-high-molecular-weight polyethylene (UHMWPE), Nylon 6, Nylon 6-6, polytetrafluoroethylene (PTFE/Teflon), acrylonitrile butadiene styrene (ABS), polycarbonates (PC), polyamides (PA), polybutylene terephthalate (PBT), polyethylene terephthalate (PET), polyphenylene oxide (PPO), polysulphone (PSU), polyetherketone (PEK), polyetheretherketone (PEEK), polyimides, polyphenylene sulfide (PPS), polyoxymethylene plastic (POM/Acetal), high-density polyethylene, polyvinyl chloride, low-density polyethylene, polypropylene, polyamides, acrylonitrile butadiene styrene, polycarbonate/acrylonitrile butadiene styrene, and polyetheretherketone. In general, the condensation trough can be made by injection molding from a polymer or resin including a thermoplastic (e.g. nylon, polyethylene and polystyrene), thermoset (e.g. epoxy and phenolic) or an elastomer. In some embodiments, the condensation trough can be transparent to minimize obstruction of light.

In some embodiments, the condensation trough can be formed by a dual durometer extrusion process as known to those of skill in the art to produce structure having both rigid and flexible sections. For example, the condensation trough can include a rigid mounting flange section and a flexible reservoir section. The condensation trough can also be integrally molded with flexible gasketing on the exposed, underside surface that contacts the top of the roof curb so as to enable a leak-tight seal where the skylight assembly attaches to the roof curb. The flexible gasketing section can have any shape effective to form a leak-tight seal with the top of the roof curb. See, for example, FIGS. 7A-7D. A dual durometer condensation trough of the invention can be made of various combinations of polymers including PVC to PVC, PVC to urethanes, PVC to thermoplastic elastomer (TPE) and polypropylene to thermoplastic rubber (TPR) using methods known to those of skill in the art.

Molded Frame

The glazing and condensation trough are held together through a molded frame that encases the outer edges of the glazing/condensation trough subassembly. The molded frame can be made of any moldable polymeric material or resins known to those of skill in the art including, without limitation, metals, elastomers, thermoplastics or thermosetting polymers. Examples of moldable polymeric materials include, without limitation, thermoplastics such as polyester resin, acetal resin, nylon resin and other engineering-type thermoplastics such as acetals. Additional examples include: a urethane composite, ultra-high-molecular-weight polyethylene (UHMWPE), Nylon 6, Nylon 6-6, polytetrafluoroethylene (PTFE/Teflon), acrylonitrile butadiene styrene (ABS), polycarbonates (PC), polyamides (PA), polybutylene terephthalate (PBT), polyethylene terephthalate (PET), polyphenylene oxide (PPO), polysulphone (PSU), polyetherketone (PEK), polyetheretherketone (PEEK), polyimides, polyphenylene sulfide (PPS), polyoxymethylene plastic (POM/Acetal), high-density polyethylene, polyvinyl chloride, low-density polyethylene, polypropylene, polyamides, acrylonitrile butadiene styrene, polycarbonate/acrylonitrile butadiene styrene, and polyetheretherketone. Thus, a thermoplastic such as nylon, polyethylene and polystyrene, a thermoset such as epoxy and phenolic, or an elastomer can be used in the injection molding.

The frame can be molded by injection molding including reaction injection molding (RIM); injection-compression molding, reinforced reaction injection molding (RRIM), in which a reinforcing agent such as glass fibers or mica is used; or structural reaction injection molding (SRIM) in which fiber meshes are used as a reinforcing agent. Methods for performing injection molding are known to those of skill in the art. See, for example, Injection Molding Handbook, Osswald et al. eds., Hanser Verlag 2008.

The frame is molded around the edge of a subassembly that includes an outer glazing, optionally one or more inner glazings and any sealer between the glazings where there are more than one glazing, and a condensation trough. Thus, the one or more glazings and condensation trough, as well as any sealer disposed between the components are assembled. The resulting subassembly is then inserted into a mold and moldable polymer is injected into the mold around the edges of the subassembly to form a frame that encapsulates the edges of the subassembly. As the condensation trough of the invention is better able to seal off the liquid mold during the molding process relative to the glazings, by incorporating the subassembly into the mold for the injection molding process, an improved skylight assembly can be produced.

The molded frame includes an outer flange section, a body section with one or more inner flanges, a roof curb collar and optionally, gasketing on the underside of the center body that contacts the top of the roof curb when the skylight assembly is mounted on the roof curb.

The outer flange section (e.g. FIG. 1C, section 80A) is molded over the peripheral flange of the outer glazing, thereby adhering to the outer surface of the peripheral flange of the outer glazing to form a leak-tight joint.

The body (e.g. FIG. 1C, section 80B) can be integrally molded with one or more flanges that is embedded between and around one or components of the skylight assembly. Where a skylight assembly includes an outer glazing and an inner glazing with a sealer disposed between the flanges of the two glazings, the body is integrally formed with a flange extending into the space between the two glazings to the edge of the sealer thereby forming a leak-tight joint with the edges and surfaces of the flanges and sealer. Similarly, where a condensation trough includes a β-shape flange, two similarly sized flanges, stacked one above the other in parallel configuration as illustrated in FIGS. 1C and 2C, the body is integrally formed with an inner flange extending into the channel of the β-shape flange. See for example, FIG. 1C. The body of the frame also includes an interior underside that can be flushed with the edge of the flange of the condensation trough, for example, as shown in FIG. 1C). A foam seal or gasket (e.g., FIG. 1C, seal or gasket 90) can be attached to the interior underside of the molded frame to produce a leak-tight seal with the roof curb surface on which the skylight assembly is mounted. Alternatively, the gasket can be integrally molded to the interior underside of the frame and/or to the underside of the condensation trough flange (e.g. FIGS. 7A-7D).

The frame is also integrally formed with a side roof curb collar (e.g. FIG. 1C, collar 80C) that encircles the upper section of a roof curb on which the skylight assembly can be mounted. The upper portion of the roof curb collar adjoins the lower portion of the body, and the lower portion of the roof collar can be molded with a depth that facilitates stacking of multiple skylight assemblies. For example, the effective depth of the collar (i.e. actual depth from the end of the collar to underside of the center body of frame or to the underside of a seal or gasket, e.g. seal or gasket 90 of FIGS. 1C and 3C) can generally correspond to the height of the narrower, tapered section of the center body of the frame (represented by surfaces 80-2 and 80-3) as shown in FIG. 3C. Similarly, the exterior taper in the body section of the frame (represented by surfaces 80-2 and 80-3) can also be of an angle that provides clearance and facilitate stacking as shown in FIG. 3C. Thus, the frame can have a narrower upper portion and a wider lower portion that enables efficient stacking of two or more units—one partially within the other.

Specific embodiments of the invention are described in the following examples, which do not limit the scope of the invention described in the claims.

EXAMPLE

Example 1

Skylight Assembly

Figure 1A:
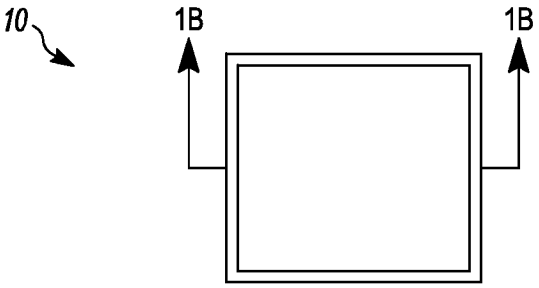
FIGS. 1A-1D are several views of a skylight assembly of the invention including: a top view (1A), a sectional view along section line 1B-1B (1B); an enlarged view of portion 1C (1C), and an exterior perspective view of a corner of the skylight assembly showing a cross-section of one side of the assembly taken along section line 1B-1B (1D).
Figure 1B:
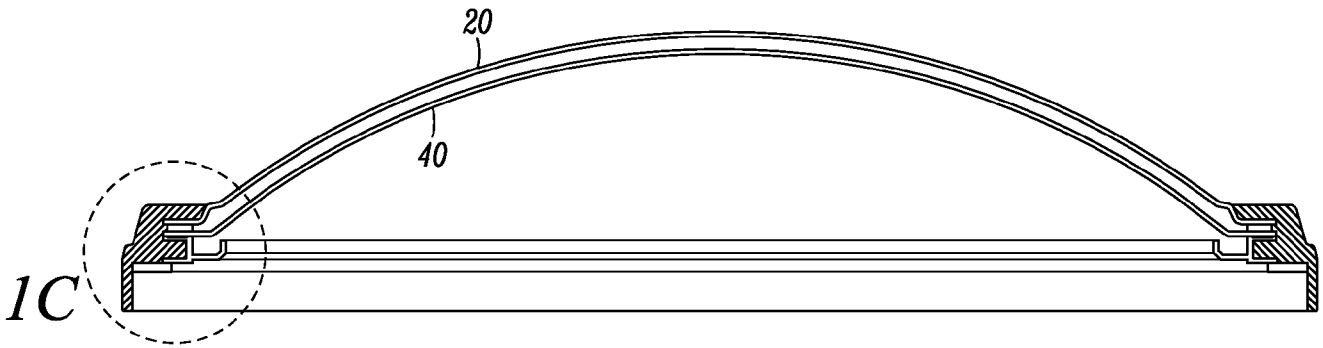
Figure 1C:
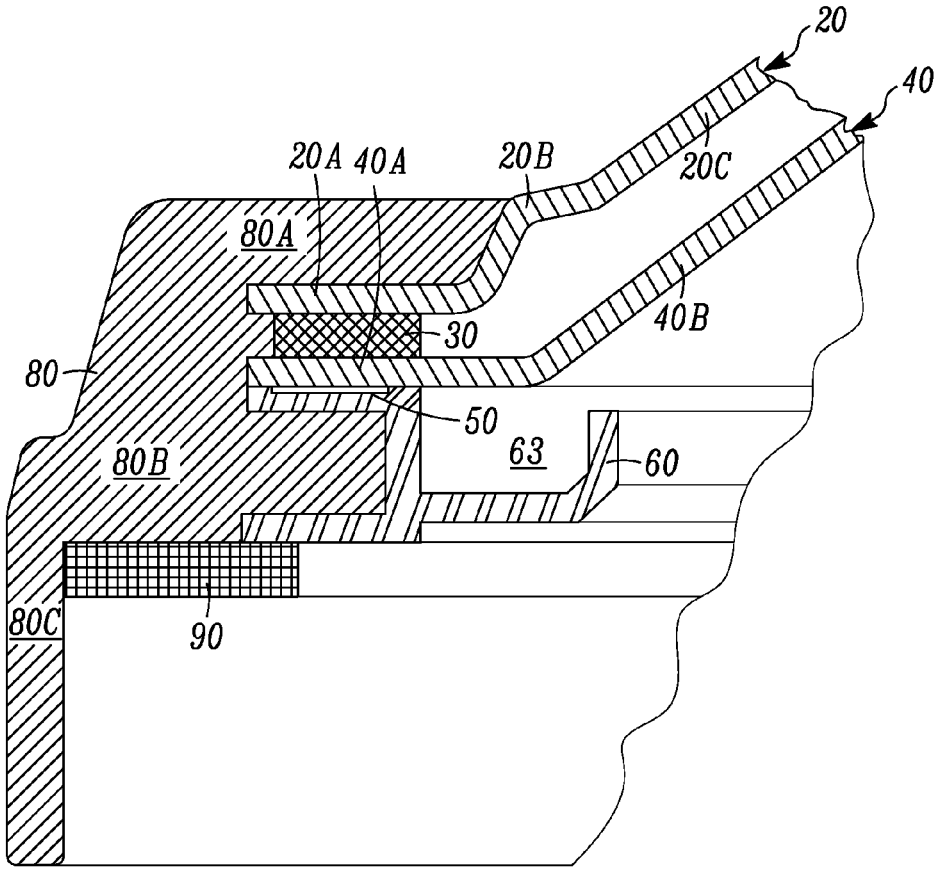

An embodiment of a skylight assembly of the invention is shown in FIGS. 1A-1D. FIG. 1A provides a top view of skylight assembly 10 highlighting the quadrilateral footprint of the assembly, and FIG. 1B provides a sectional view along section line 1B-1B. The top view of skylight assembly 10 shows a structure having four similar, perpendicular sides, and the sectional view illustrates a bi-layer glazing in which outer glazing 20 is stacked above second, inner glazing 40. An enlarged view of portion 1C (FIG. 1C) shows that skylight assembly 10 also includes condensation trough 60 and frame 80. Condensation trough 60 is stacked beneath inner glazing 40, the edges of condensation trough 60 in alignment with the edges of glazing 20 and 40, and frame 80 is molded around the edges of the glazings and condensation trough to form an assembly.

As illustrated in FIGS. 1B and 1C, the outer and inner glazings of the skylight assembly have a peripheral flange section and a center body or dome. Outer glazing 20 has peripheral flange 20A adjoining step-up section 20B, which adjoins central dome section 20C. Second glazing 40 has peripheral flange 40A adjoining central dome section 40B with a similar curvature as that of dome section 20C of glazing 20. Thus, central dome section 20C of outer glazing 20 and central dome section 40B of the inner glazing are substantially parallel. Similarly, peripheral flange 20A of outer glazing 20 and peripheral flange 40A of inner glazing 40 are substantially parallel as illustrated in FIG. 1C.

Condensation trough 60 has a trough or reservoir section for receiving condensate from the skylight and two flanges having substantially similar peripheral edges as that of glazing 20 and 40 as illustrated in FIG. 1C. Condensation trough 60 is secured beneath inner glazing 40, the flanges of condensation trough 60 stacked beneath the flanges of the glazings, their edges in alignment and encased within frame 80. Frame 80 is molded around the edges of glazing 20, glazing 40 and trough 60 to form leak-tight joints. The reservoir section of condensation trough 60 extends laterally from the mounting flange section of condensation trough 60 beneath the effective edge of the glazing (the exposed or visible portion of peripheral flange 40A) into the skylight opening to beneath a peripheral portion of central dome section 40B of glazing 40 (see FIG. 1C). As such, the reservoir section of condensation trough 60 is effective to receive condensate from the interior surface of inner glazing 40.

Skylight assembly 10 also includes sealers disposed between the peripheral flanges of the glazings and between inner glazing 40 and the upper flange of the condensation trough 60 as illustrated in FIG. 1C. Sealer 30 is placed between flange 20A and flange 40A of outer glazing 20 and inner glazing 40, respectively, to form a fluid-tight seal. Similarly, sealer 50 is placed in between the flange 40A of inner glazing 40 and the upper flange of condensation trough 60 to form a fluid-tight seal. Thus, glazing 20, sealer 30, glazing 40, sealer 50 and condensation trough 60 are stacked so that the flanges of glazing 20, glazing 40 and condensation trough 60 align to form a sub-assembly around which frame 80 is molded flushed with the lower edge of the condensation trough 60. Gasket 90 is secured to the inner, underside of frame 80 and a section of the lower flange of condensation trough 60 as shown in FIGS. 1C and 1D.

Figure 1D:
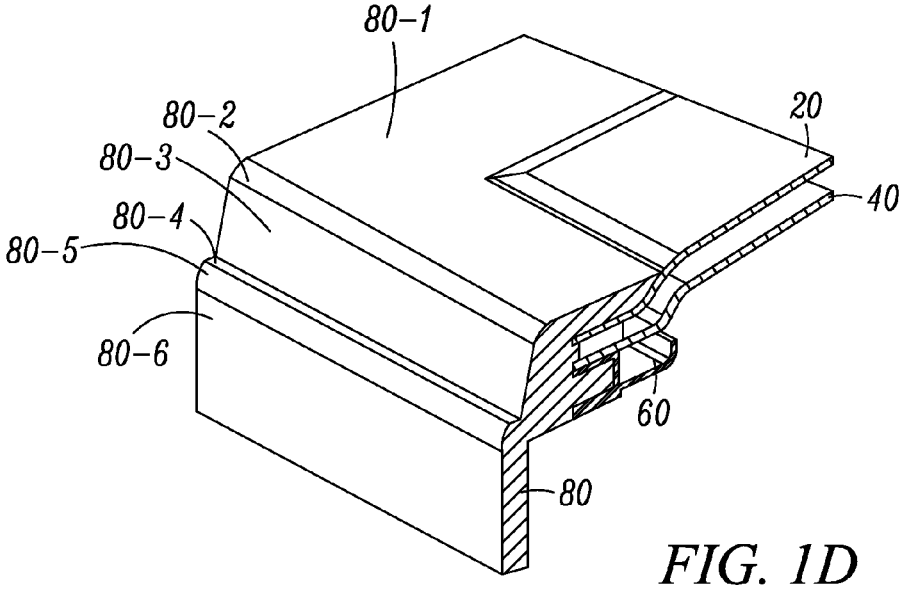

The sectional view of FIG. 1C and the outer perspective view of a corner of the skylight assembly provided in FIG. 1D show that frame 80 has an upper portion and a wider lower portion. The upper portion has lateral surface 80-3 offset from lateral surface 80-5 of the lower portion, lateral surface 80-3 tapering upwardly and inwardly towards the dome section of the glazing. Substantially horizontal surface 80-4 resulting from the lateral surface offset facilitates stacking of the skylight assemblies as further discussed below and illustrated in FIGS. 3A-3C.

The upper portion and wider lower portion of molded frame 80 are formed by outer flange 80A, body 80B with one or more inner flange extensions, and roof curb collar 80C. Outer flange 80A forms a leak-tight joint with flange section 20A and the side of step-up section 20B. Body 80B has flanges that extend into channels formed by the peripheral flanges of glazing 20 and glazing 40 and sealer 30 and into the opening between the flanges of condensation trough 60. The inner surfaces of outer flange 80A and body 80B contact the encased surfaces of the glazings and condensation trough to form leak-tight joints therewith. The lower portion of body 80B is contiguous with a downwardly elongated section or roof curb collar 80C. Curb collar 80C forms an opening beneath body 80B and condensation trough 60 for accommodating a roof curb on which the skylight assembly is mounted (see also FIG. 4). Roof curb collar 80C of frame 80 wraps around the upper section of a roof curb on which the assembly is mounted. In addition, the opening formed by curb collar 80C is at least as wide as the upper portion of frame 80, which allows for efficient stacking of one skylight assembly above the other as further discussed below and illustrated in FIGS. 3A-3C.

Thus, the external surfaces of the molded frame (FIG. 1D) includes: (1) surface 80-1, a generally horizontal top flushed with the edge of the raised surface of step-up section 20B of the glazing 20; (2) taper 80-2 and lateral side 80-3, which extends downwardly and outwardly to substantially horizontal surface 80-4, allow clearance for the roof curb collar of a second skylight assembly when one is stacked above another; (3) surface 80-4, a generally horizontal surface having a width about the width of roof curb collar 80C; and (4) tapered side 80-5 adjoining lateral side 80-6 of roof curb collar 80C.

Example 2

Condensation Trough

Figure 2B:
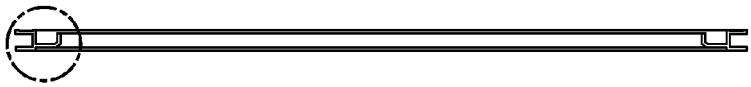
FIGS. 2A-2G are several views of a condensation trough of the invention including: a top view (2A), a sectional view of the trough along section line 2B-2B (2B); an enlarged view of portion 2C (2C); an enlarged top view of a corner of the trough shown in FIG. 2A (2D); a perspective view of the trough shown in FIG. 2A (2E), and enlarged views of corners 2F and 2G (2F, 2G, respectively).
Figure 2A:
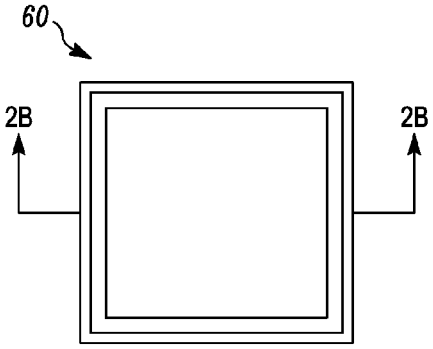
Figure 2C:
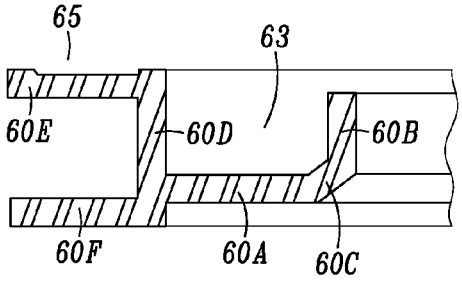
Figure 2G:
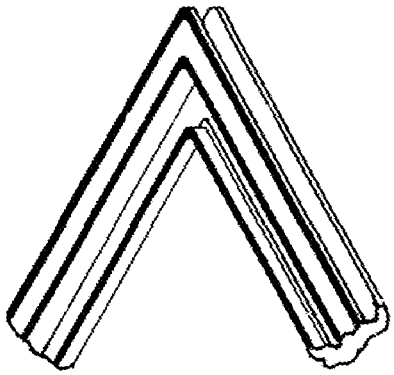
Figure 2F:
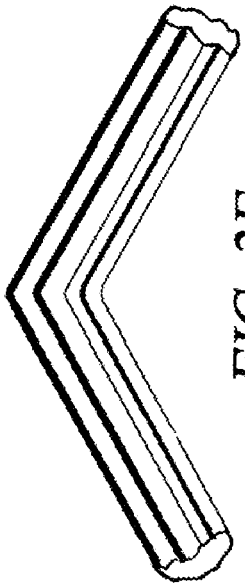
Figure 2E:
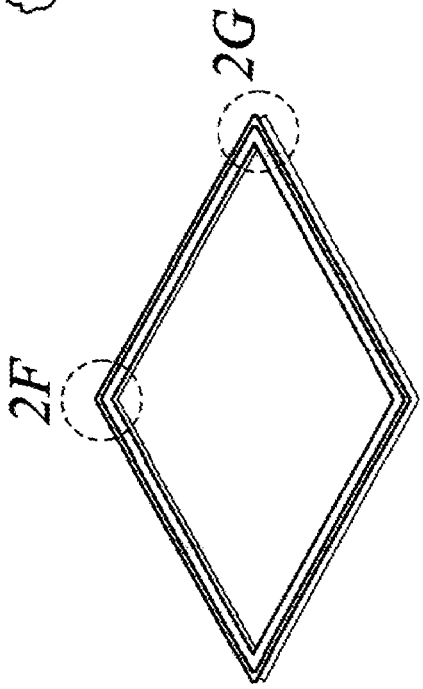
Figure 2D:
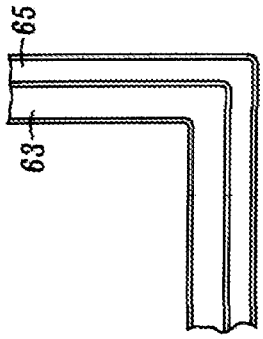

FIGS. 2A-2D provide various views of a condensation trough of the invention. FIG. 2A, which provides a top view of condensation trough 60, shows that condensation trough 60 has four similar, perpendicular sides resembling skylight assembly 10 of FIG. 1A. A cross-sectional view of condensation trough 60 along section line 2B-2B is shown in FIG. 2B, and an enlarged view of region 2C of the cross-section is shown in FIG. 2C. Condensation trough 60 has a reservoir section that includes channel 63 formed by sections 60A, 60B, 60C and 60D to receive condensate from and/or around the skylight. Section 60C is angled to align with the curvature of the glazing with which condensation trough 60 is assembled, and trough sections 60A, 60B and 60C are configured to allow for the stacking of two or more skylight assemblies as further discussed below and illustrated in FIGS. 3A-3C. The reservoir section adjoins a mounting flange section formed by section 60D and flange 60E and 60F around which frame 80 is molded. The upper flange 60E is configured with groove 65 to accommodate seal 50 illustrated in FIG. 1C. The relative position of channel 63 and groove 65 is illustrated in FIG. 2C and FIG. 2D, the latter providing an enlarged, top view of a corner section of condensation trough 60. FIG. 2E is a top perspective view of condensation trough 60 and FIGS. 2F and 2G are enlarged views corners 2F and 2G. The enlarged views of portions of condensation trough 60 provided by FIGS. 2D, 2F and 2G illustrate a closed loop structure in which the reservoir section with channel 63 is situated on the inner portion of the loop structure, while the adjacent mounting flange section with groove 65 is situated along the outer portion of the loop structure, channel 63 and groove 65 extending in parallel along the entire structure.

Example 3

Stack Assemblies

Figure 3A:
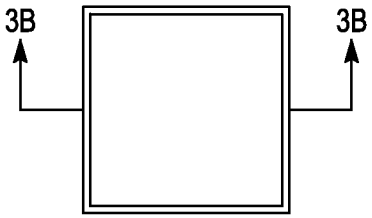
FIGS. 3A-3C are several views of three stacked skylight assemblies including: a top view (3A); a cross-sectional view of the stack along section line 3B-3B (3B); and an enlarged view of portion 3C (3C).
Figure 3B:
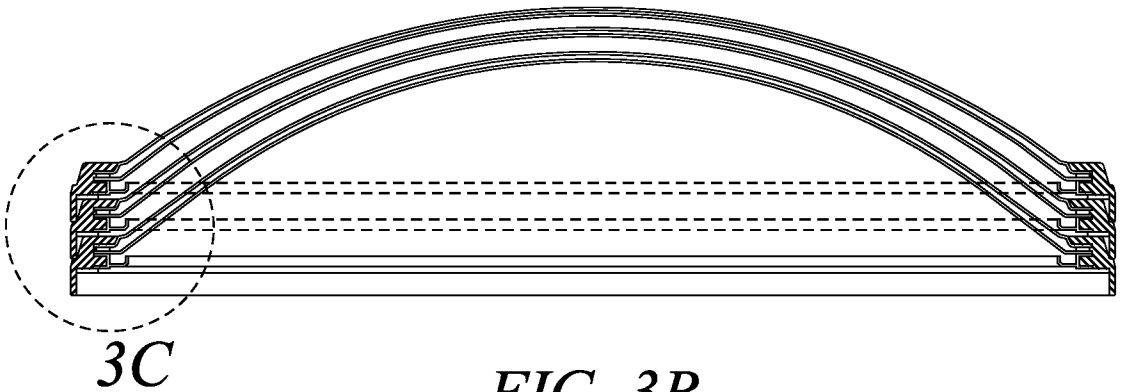
Figure 3C:
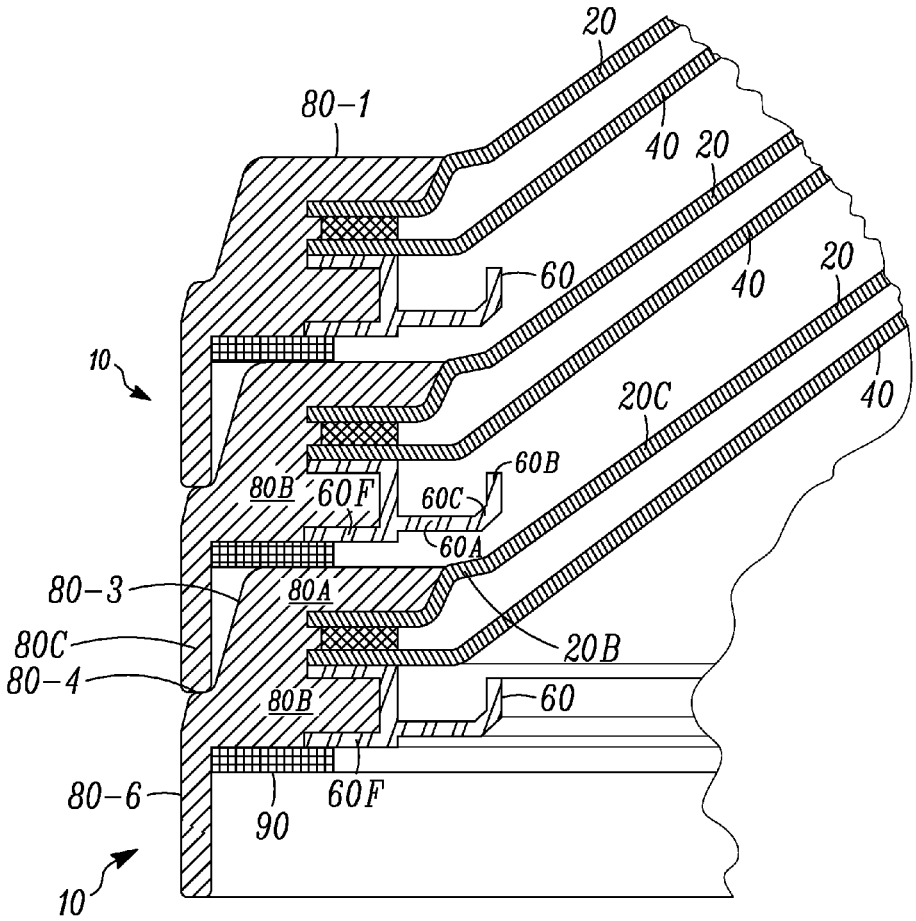

FIGS. 3A-3C illustrate relative positions of various components of skylight assembly 10 when two or more units are stacked. A top view of a stack of three skylight assemblies is shown in FIG. 3A. A sectional view of the stack along section line 3B-3B is shown in FIG. 3B, and an enlarged view of region C is shown in FIG. 3C. The configuration and surface contours of skylight assembly 10 enables efficient stacking of two or more units for ease of storage and/or transport. The sectional views provided by FIGS. 3B and 3C illustrate stacking of two or more skylight assembly 10 units one partially within the other. As illustrated in FIGS. 2C and 3C, the configurations of outer glazing 20 and inner condensation trough 60 allow for clearance between outer glazing 20 and condensation trough 60 when multiple units are stacked. For example, reservoir base section 60A of condensation trough 60 is elevated relative to lower flange section 60F. The offset of sections 60A and 60F provides clearance between the reservoir section of the condensation trough and the rising center dome section of glazing 20. In addition, the length of base section 60A, as well as the angle or orientation of section 60C together form an outer contour substantially similar to, or in substantial alignment with, the outer surface contour formed by outer flange 80A, raised section 20B and edge of center dome 20C. Gasket 90 situated beneath frame body section 80 and flange section 60F provide additional clearance space between the lower surfaces of condensation trough 60 and the surface of outer flange 80A, raised section 20B and edge of center dome 20C. Similarly, the offset of exterior tapered surface 80-3 from lateral surface 80-6 of roof curb collar 80C provides clearance and surface 80-4 for placement of roof curb collar 80C of another skylight assembly unit as shown in FIG. 3C. Thus, contact between units in the stack occurs between gasket 90 of the upper unit and surface 80-1 of the lower unit and between a roof curb collar 80C of the upper unit and surface 80-4 roof curb collar 80C of the lower unit as shown in FIG. 3C.

Example 4

Skylight Assembly Mounted on Roof Curb with Snap-Fit Extension Frame

FIG. 4 provides a sectional view of a skylight assembly of the invention mounted on roof curb 140 with adjacent light shaft 130. The assembly includes glazings 20-1 and 20-2, which have similar peripheral flanges and center domes. Glazings 20-1 and 20-2 are stacked and secured together at their peripheral flanges using sealer 30, their edges in alignment and their peripheral flanges and center domes in parallel configuration one beneath the other. The assembly includes condensation trough 60, stacked beneath inner glazing 20-2 so that the edges of the two similarly sized and parallel flanges of condensation trough 60 align with the edges of the glazings above the trough. As in skylight assembly 10 illustrated in FIG. 1C, condensation trough 60 includes a reservoir section that extends laterally from the mounting flange section beneath the effective edge of the glazing (the exposed or visible portion of the peripheral flange of glazing 20-2) into the skylight opening to beneath the peripheral portion of the center dome of glazing 20-2 (FIG. 4). Molded frame 80 is formed around the peripheral flanges of the glazings and condensation trough sub-assembly thereby encasing the edges of the subassembly. Molded frame 80 is also integrally molded with roof curb collar section 80C that forms an opening of a size sufficient to accommodate roof curb 140 when the assembly is mounted on the roof curb 140 as shown. Gasket 90 is secured to the underside of frame 80 and a part of the lower flange of the condensation trough, to which the underside of frame 80 is flushed to form a leak-tight seal between the skylight assembly and curb 140.

The assembly in FIG. 4 also includes snap-fit extension frame 100, which is secured to condensation trough 60 through a snap-fit mechanism. More specifically, extension frame 100 has a double-cantilever structure in which one arm engages with the base section 60A of the condensation trough, while the other arm provides a support for glazing 200. A cantilever hook on the anchor arm of extension frame 100 allows extension frame 100 to securely attach to section 60B of condensation trough 60. Snap-fit extension frame 100 can be added to the skylight assembly after it is formed, for example, during installation or mounting of the skylight assembly on roof curb 140. As such third glazing 200 can be added to the skylight for increased insulation during field installation as needed. As such, a skylight assembly of the invention has an improved condensation management system as well as mechanism for increasing insulation capacity.

Example 5

Modified and/or Reinforced Condensation Troughs

Figure 5A:
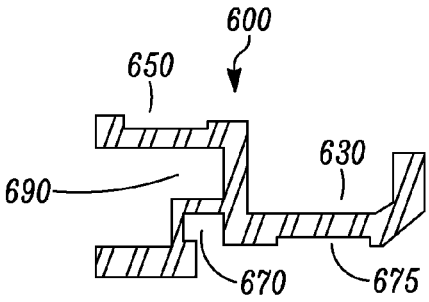
FIGS. 5A-5F are cross-sectional views of a skylight assembly, sub-assembly and components thereof including: a cross-sectional view of a condensation trough (5A) and a corresponding snap-fit frame extension (5B); the condensation trough of FIG. 5A attached to a bi-layer glazing (5C) with a third glazing held in place by a snap-fit frame extension (5D); and embodiments of skylight assemblies that include a third flat or dome-shaped glazing (5E & 5F, respectively).
Figure 5B:
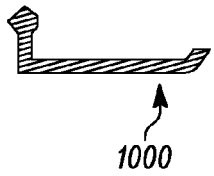
Figure 5C:
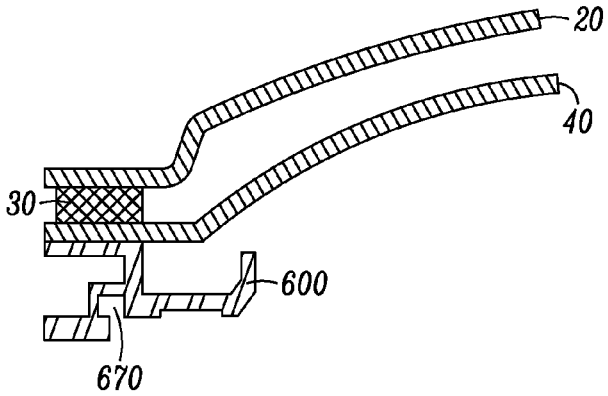
Figure 5D:
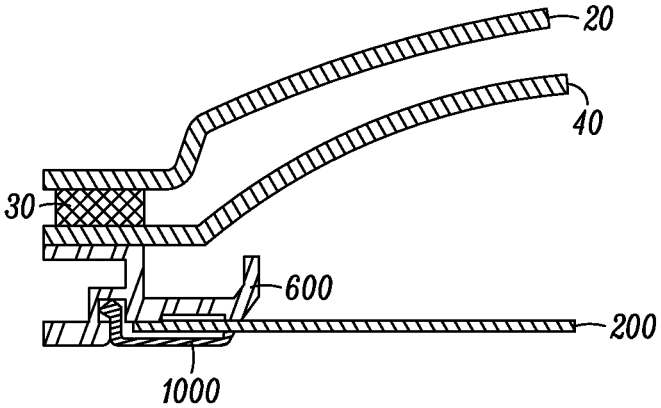
Figure 5E:
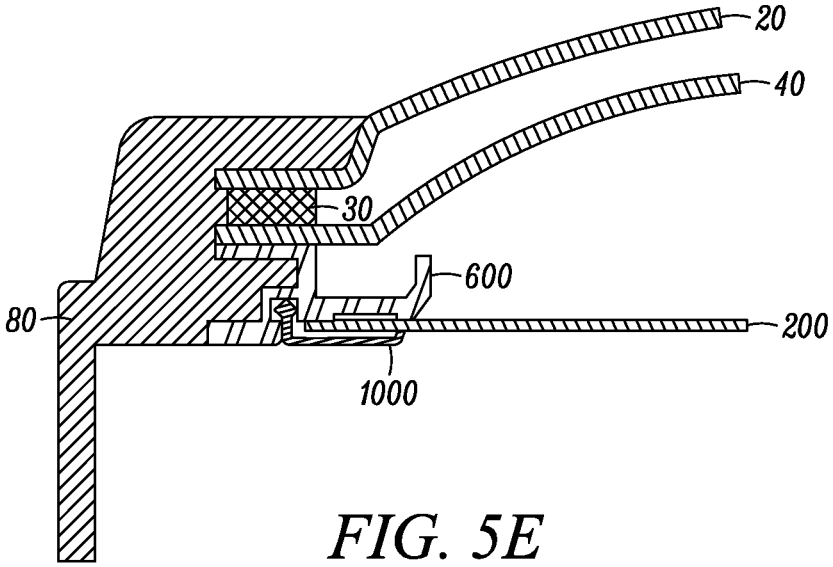
Figure 5F:
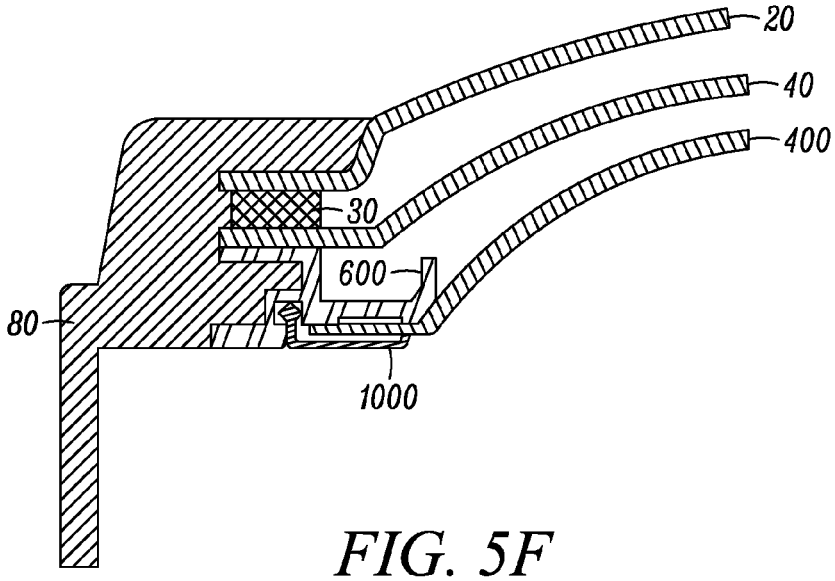

FIGS. 5A-5D illustrate another embodiment of a condensation trough of the invention. FIG. 5A provides a sectional view of condensation trough 600, which has underside groove 670 for mating with a snap-fit extension frame, and underside groove 675 to accommodate a sealer means. FIG. 5B provides a sectional view of snap-fit extension frame 1000 that can be used with condensation trough 600. Snap-fit extension frame 1000 has a cantilever structure with an anchor arm that engages with condensation trough 600 at underside groove 670 and a cantilever arm extending laterally beneath section 60A of condensation trough 600 to support a glazing. FIG. 5C illustrates the cross-section of a sub-assembly of glazing 20, glazing 40, sealer 30 and condensation trough 600, while FIG. 5D illustrates the interaction of condensation trough 600 with snap-fit extension frame 1000 to support third glazing 200. FIGS. 5E and 5F depict skylight assemblies that include third glazing 200 and 400, respectively, held in place by snap-fit extension frame 1000.

Figure 6B:
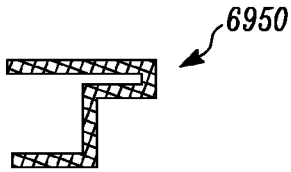
FIGS. 6A-6C are sectional views of a modified condensation trough (6A) configured to retain a stiffening rail, the cross-section of which is shown in 6B and a subassembly incorporating the reinforced condensation trough with snap-fit extension frame supporting a third glazing (6C).
Figure 6A:
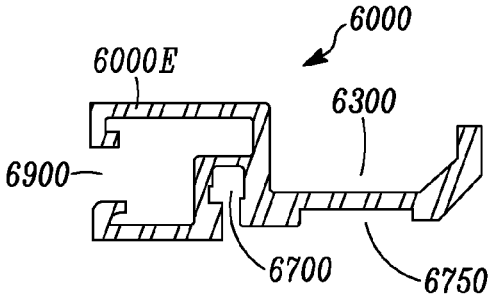
Figure 6C:
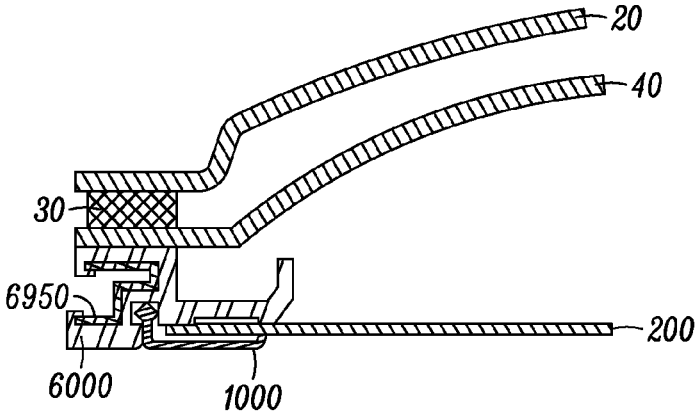

FIGS. 6A-6C illustrate another embodiment of a condensation trough of the invention. FIG. 6A provides a sectional view of condensation trough 6000. Condensation trough 6000 resembles condensation trough 600 although opening 6900 is modified to more securely retain a stiffening rail for added strength. FIG. 6B provides a sectional view of stiffening rail 6950 configured to fit within opening 6900. FIG. 6C provides a sub-assembly in which a bi-layer glazing (glazing 20 and 40 with sealer 30 disposed between the flanges of the glazings) is stacked above and secured to reinforced condensation trough 6000. Condensation trough 6000 is reinforced by insertion of stiffening rail 6950 to recess 6900. A third glazing, glazing 200, is held in place using snap-fit extension frame 1000, which is mated to condensation trough 6000 at recess 6700 using a snap-fit mechanism.

Figure 7C:
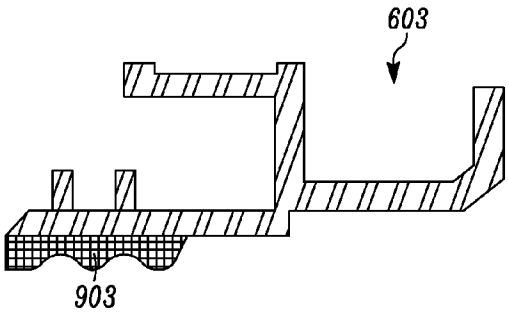
FIGS. 7A-7D are sectional views of three condensation troughs with integral gasketing (7A, 7B & 7C) and a sectional view of a skylight assembly incorporating a condensation trough with integral gasketing (7D).
Figure 7D:
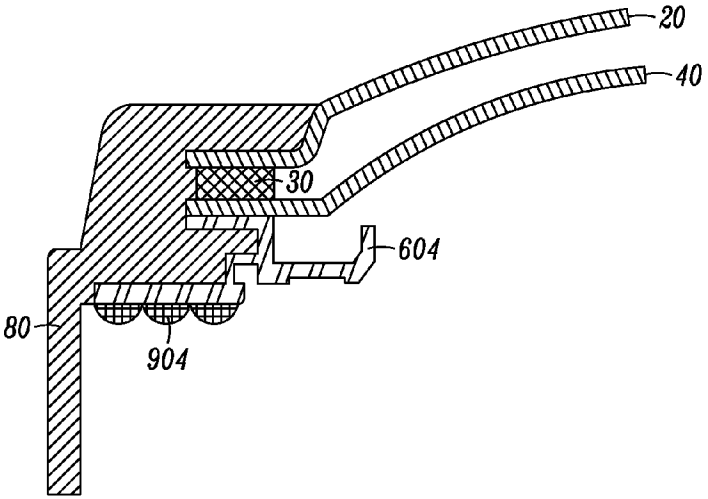
Figure 7A:
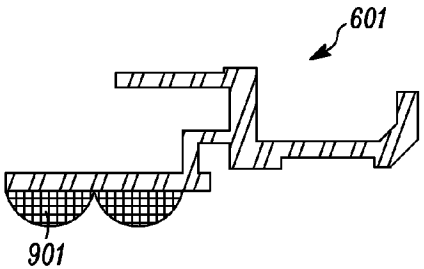
Figure 7B:
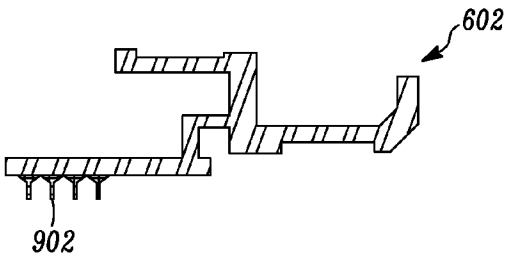

Additional embodiments of a condensation trough of the invention are shown in FIGS. 7A-7D. In these embodiments, each of condensation troughs 601, 602, 603 and 604 includes an integrally molded gasket component 901, 902, 903 and 904, respectively. FIG. 7D depicts a skylight assembly that includes condensation trough 604 with integrally molded gasket 904.

OTHER EMBODIMENTS OF THE INVENTION

While the invention has been described in conjunction with the detailed description, the foregoing description is intended to illustrate and not limit the scope of the invention, which is defined by the scope of the claims. Other aspects, advantages, and modifications are within the scope of the following claims.

The terms and expressions that have been employed are used as terms of description and not of limitation, and there is no intent in the use of such terms and expressions to exclude any equivalent of the features shown and described or portions thereof. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. In addition, the invention has been described broadly and generically herein. Each of the narrower species and subgeneric groupings falling within the generic disclosure also form part of the invention.

As used herein and in the appended claims, the singular forms "a," "an," and "the" include plural reference unless the context clearly dictates otherwise. Under no circumstances may the patent application be interpreted to be limited to the specific examples or embodiments or methods specifically disclosed herein.

What is claimed is:

1. A skylight assembly comprising:

(a) an outer glazing secured in stacked configuration to an inner glazing, the glazings comprising peripheral flange sections and central body sections having substantially similar curvatures;

(b) a first sealer means disposed between the flanges of the outer and inner glazings to form leak tight joints;

(c) a condensation trough secured beneath an edge of the inner glazing comprising a reservoir section situated beneath an effective edge of the inner glazing to receive condensate from the interior surface of the inner glazing, the reservoir section adjoining a mounting flange section comprising two substantially parallel flanges in stacked alignment beneath the flange of the inner glazing;

(d) a second sealer means disposed between the flange of the inner glazing and a flange of the condensation trough to form a leak-tight joint;

(e) a molded frame comprising an upper portion and a wider lower portion, wherein the upper portion comprises an outer flange one end portion of which is contiguous with a body section, the outer flange and body section encasing the peripheral flanges of the glazings and mounting flange section of the condensation trough, the outer flange forming a leak-tight joint with the top surface of the peripheral flange of the outer glazing, the outer flange and body section comprising interior surfaces that contact encased portions of the glazings, sealer means and condensation trough to form leak-tight joints therewith, the body section comprising an underside flushed with the lower edge of the mounting flange section, and wherein the wider lower portion of the frame comprises the lower portion of the body section and a downwardly elongated roof curb collar, the upper portion of which is contiguous with the lower portion of the body section, the collar forming an opening below the condensation trough effective to accommodate the upper portion of the molded frame for stacking two or more skylight assemblies one partially within the other; and (f) a gasket secured to the underside of the center body section of the frame and a portion of the lower edge of the mounting flange section.

2. The skylight assembly of claim 1, wherein the center body of the outer and inner glazings are dome-shaped.

3. The skylight assembly of claim 1, wherein the outer glazing further comprises a raised step section adjoining the peripheral flange, the raised step section adjoining and encircling a central dome.

4. The skylight assembly of claim 3, wherein the edge of the raised portion of the step section is flushed with the exterior surface of the outer flange of the molded frame, and wherein the raised portion of the step section forms a gentle upward slope rising from the edge of the outer flange of the molded frame to the adjoining central dome.

5. The skylight assembly of claim 1, wherein the first sealer means comprises caulk or glazing tape.

6. The skylight assembly of claim 1, wherein the flange of the condensation trough that is secured to the flange of the inner glazing comprises a groove within which the second sealer means is disposed.

7. The skylight assembly of claim 6, wherein the second sealer means comprises a glazing compound.

8. The skylight assembly of claim 1, wherein the condensation trough comprises a closed loop structure that extends beneath the entire edge of the inner glazing.

9. The skylight assembly of claim 1, wherein the reservoir section of the condensation trough substantially aligns with the slope of the outer glazing thereby enabling two or more skylight assemblies to be stacked one on the other.

10. The skylight assembly of claim 9, wherein the reservoir section of the condensation trough comprises a substantially horizontal base adjoining a substantially diagonal corner segment, which, in turn adjoins a substantially vertical wall segment, and wherein the horizontal base, diagonal corner segment and vertical wall segment form a structure that aligns with the slope of the outer glazing thereby enabling two or more skylight assemblies to be stacked one on the other.

11. The skylight assembly of claim 1, wherein the condensation trough further comprises an underside groove for securely engaging a snap-fit extension frame.

12. The skylight assembly of claim 11, wherein the condensation trough comprises a structural stiffener.

13. The skylight assembly of claim 12, wherein the structural stiffener is a stiffening rail lining the channel formed between the flanges of the condensation trough thereby strengthen the mounting flange section of the condensation trough.

14. The skylight assembly of claim 11, further comprising an additional glazing supported by a snap-fit extension frame, wherein the snap-fit extension frame comprises a cantilever structure, the extension frame being secured to the condensation trough through an anchor arm having a hooked, studded or beaded end that engages with the underside groove of the condensation trough.

15. The skylight assembly of claim 14, wherein the additional glazing comprises a substantially flat panel or a dome-shaped panel.

16. The skylight assembly of claim 1, further comprising a snap-fit extension frame secured to the condensation trough through a snap-fit mechanism, wherein the snap-fit extension frame comprises a double-cantilever structure, the extension frame being secured to the condensation trough through an anchor arm comprising a hooked, studded or beaded end.

17. The skylight assembly of claim 16, further comprising an additional glazing supported by the snap-fit extension frame.

18. The skylight assembly of claim 17, wherein the additional glazing comprises a substantially flat panel or a dome-shaped panel.

19. The skylight assembly of claim 1, wherein the frame and gasket are integrally molded.

20. The skylight assembly of claim 1, wherein the condensation trough is integrally molded with the frame.

* * * * *